United States Patent [19]

Young

[11] Patent Number: 4,664,685

[45] Date of Patent: May 12, 1987

[54] LINEAR DRIVE MOTOR CONTROL IN A CRYOGENIC REFRIGERATOR

[75] Inventor: Niels O. Young, Eagle, Id.

[73] Assignee: Helix Technology Corporation, Waltham, Mass.

[21] Appl. No.: 799,486

[22] Filed: Nov. 19, 1985

[51] Int. Cl.[4] ..... F25B 9/00; F01B 29/10

[52] U.S. Cl. ..... 62/6; 60/518; 318/617; 324/177; 417/45

[58] Field of Search ..... 62/6; 417/45; 60/518, 60/520; 324/177; 318/617, 652

[56] References Cited

U.S. PATENT DOCUMENTS

| | | | |
|---|---|---|---|
| 1,100,280 | 6/1914 | Alexanderson | 324/177 |
| 2,649,572 | 8/1953 | Carlson | 324/177 |
| 2,905,876 | 9/1959 | Hillman | 324/177 X |
| 3,754,154 | 8/1973 | Massie | 310/17 |
| 3,991,586 | 11/1976 | Acord | 62/6 |
| 4,345,442 | 8/1982 | Dorman | 62/160 |
| 4,389,849 | 6/1983 | Gasser et al. | 62/6 |
| 4,397,155 | 8/1983 | Davey | 62/6 |
| 4,417,448 | 11/1983 | Horn et al. | 62/6 |
| 4,534,176 | 8/1985 | Horn et al. | 62/6 |
| 4,567,726 | 2/1986 | Vitale et al. | 60/518 X |

*Primary Examiner*—William E. Wayner

*Attorney, Agent, or Firm*—Hamilton, Brook, Smith & Reynolds

[57] ABSTRACT

In a Stirling cryogenic refrigerator, the movement of the displacer is monitored by sensing the back EMF in the displacer drive coil throughout displacer stroke. The back EMF signal is applied through a feedback circuit to control the phase relationship of displacer movement with a reference signal related to the pressure wave.

8 Claims, 3 Drawing Figures

LINEAR DRIVE MOTOR CONTROL IN A CRYOGENIC REFRIGERATOR

BACKGROUND

This invention relates to cryogenic refrigerators having linear drive motors such as the split Stirling refrigeration system shown schematically in FIG. 1. This system includes a reciprocating compressor 14 and a cold finger 16. A piston 17 of the compressor reciprocates in a cylinder 15 to provide a nearly sinusoidal pressure variation in a pressurized refrigeration gas such as helium. The pressure variation in a head space 19 is transmitted through a supply line 20 to the cold finger 16. The compressor piston 17 is driven by a linear drive motor including a permanent magnet 16 mounted on the piston and a drive coil 18 fixed to the cylinder 15.

Within the housing of the cold finger 16 a cylindrical displacer 26 is free to move in a reciprocating motion to change the volumes of a warm space 22 and a cold space 24 within the cold finger. The displacer 26 contains a regenerative heat exchanger 28 comprised of several hundred fine-mesh metal screen discs stacked within a cylindrical envelope to form a matrix. Other regenerators, such as those with stacked balls, are also known. Helium is free to flow through the regenerator between the warm space 22 and the cold space 24. A piston element 30 extends upwardly from the main body of the displacer 26 into a gas spring volume 32 at the warm end of the cold finger. The piston and displacer are driven by a linear drive motor including a permanent magnet 34 mounted to the piston and a drive coil 35. Detailed descriptions of the compressor and displacer drive motors can be found in my prior U.S. patent application Ser. No. 458,718, filed Jan. 17, 1983, for a Cryogenic Refrigerator with Linear Drive Motors.

Operation of the split Stirling refrigeration system will now be described. At the point in the cycle shown in FIG. 1, the displacer 26 is at the cold end of the cold finger 16 and the compressor is compressing the gas in the working volume. This compressing movement of the compressor piston 17 causes the pressure in the working volume to rise from a minimum pressure to a maximum pressure and thus warms the working volume of gas. Heat is given off to the environment from the compressor and the warm end of the cold finger. Thereafter, the displacer is moved rapidly upward. With this movement of the displacer, high-pressure working gas at about ambient temperature is forced through the regenerator 28 into the cold space 24. The regenerator absorbs heat from the flowing pressurized gas and thereby reduces the temperature of the gas.

The compressor piston 17 then begins to move up to expand the working volume. With expansion, the high pressure helium in the cold space 24 is cooled even further. It is this cooling in the cold space 24 which provides the refrigeration for maintaining a temperature gradient of over 200 degrees Kelvin over the length of the regenerator.

Finally, the displacer 26 is driven downward to the starting position of FIG. 1. The cooled gas in the cold space 24 is thus driven through the regenerator to extract heat from the regenerator. The heat added to the regenerator at an earlier time by high pressure working gas is less than the heat subtracted at this time by low pressure working gas. Therefore, there is net refrigeration.

The traditional approach to compressor drive motor design in split Stirling refrigerators has been to utilize a rotary electric drive in the compressor. Lubricated mechanical bearings and linkages are employed to convert rotary motion to oscillating motion. More recently, systems have been developed using a linear electric drive directly coupled to the compressor piston.

In order to provide an efficient refrigeration cycle, it is important that each of the compressor piston and cold finger displacer be driven full stroke in proper phase relationship to each other. To that end, a motor drive 36 supplies drive current to each of the coils 18 and 35 to establish the full stroke and the proper phase relationship. It is an object of this invention to provide a direct drive which maintains the proper strokes and phase relationship under varying operating conditions. It is particularly difficult to control the drive of the displacer because the displacer is also pneumatically driven by pressure differentials between the spring volume 32, the warm and cold volumes 22 and 24 and the volume in the regenerator 28. Several systems have been developed which rely on position feedback to provide more precise position control of the displacer and compressor. Examples can be found in U.S. Pat. Nos. 3,991,586 to Acord, 4,389,849 to Gasser et al., 4,397,155 to Davey, and 4,417,448 to Horn et al. Although such systems can increase the efficiency of a cryogenic refrigerator, they also add to the mechanical complexity of the system. This is a particular disadvantage with very small refrigerators.

SUMMARY OF THE INVENTION

In a cryogenic refrigerator, a gaseous working fluid is alternately compressed and expanded to cool a portion of the working fluid to cryogenic temperatures. A linear drive motor drives a piston element which acts on the working fluid in a thermodynamic refrigeration cycle. The linear drive motor comprises a drive coil through which current is applied to drive an armature coupled to the piston element. A detector circuit is coupled to the drive coil for sensing, throughout stroke of the piston element, an electrical parameter of the coil which is a function of movement of the armature. Motor drive circuitry which applies current to the drive coil is responsive to the sensed electrical parameter in controlling movement of the piston element throughout stroke of the piston element.

In the preferred embodiment, the detector circuit is connected to sense back EMF in a displacer drive motor. A signal derived from the back EMF is phase compared to a signal indicative of the pressure wave to establish the timing of the displacer drive.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed on illustrating the principles of the invention.

DESCRIPTION OF PREFERRED EMBODIMENTS

Figure 1:
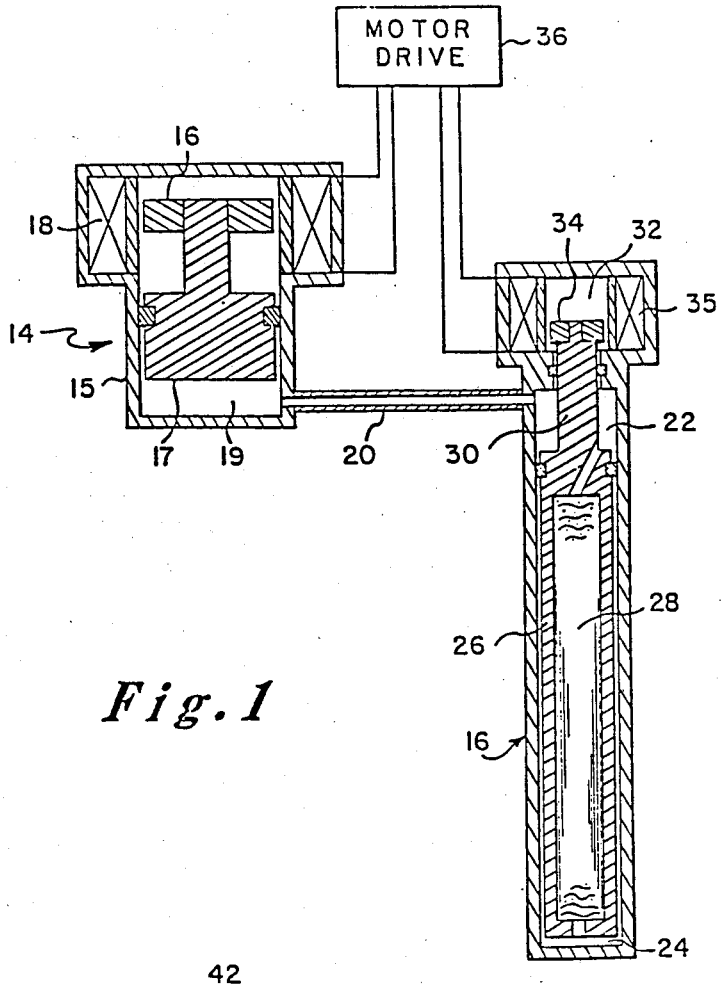
FIG. 1 illustrates a Stirling cryogenic refrigerator embodying the present invention.

A general description of a Stirling cryogenic refrigerator as shown in FIG. 1 has already been presented. For full control of a linear drive motor in the system, the movement of the piston must be monitored throughout the piston stroke. That movement may be sensed by detecting position, velocity, or acceleration because one can be derived from the other, but position is generally most useful. The present invention is directed to the means for sensing the movement of a piston driven by a linear motor and the use of that sensed movement to control the motor. Specifically, the position of either of the pistons 17 and 30 can be determined without providing any additional structure in either the compressor or cold finger by detecting the piston movement through the drive coil itself.

One approach to sensing the movement of a driven piston is to sense the back EMF created by the armature in the drive coil. The electromotive force (EMF) across the drive coil of a linear motor is a function of the ohmic drop in the coil, the self inductance of the coil, and the back EMF developed as a result of the magnetic armature moving in the coil. The back EMF thus developed is comparable to the voltage developed by an electrical generator with movement of a magnetic armature by some mechanical input. The back EMF is directly related to the velocity of the armature within the coil.

Figure 2:
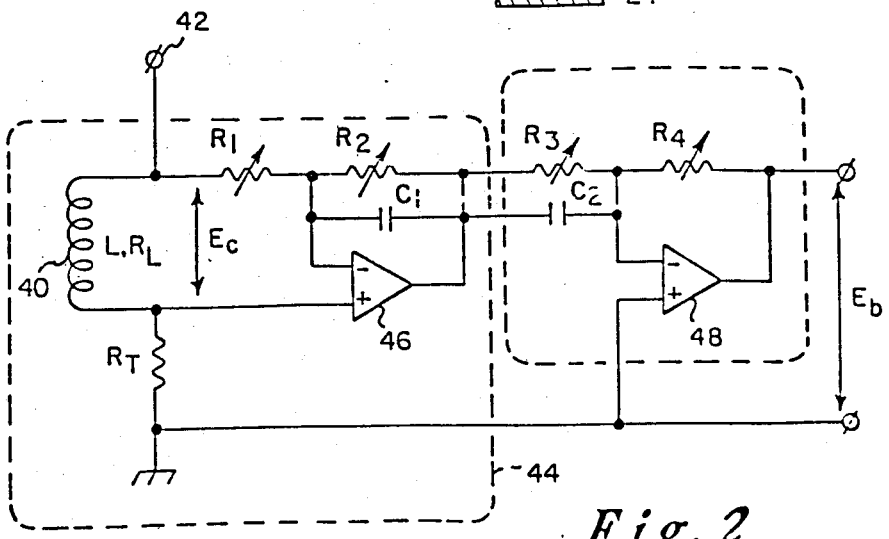
FIG. 2 is an electrical schematic of a back EMF extractor circuit for use in the motor drive of FIG. 1.

A back EMF extractor circuit for use with the present invention is illustrated in FIG. 2. Motor drive current is applied across the motor coil 40 from an input node 42. The motor coil has an inductance L and an effective resistance $R_L$. $R_L$ is the sum of the resistance of the drive coil measured with direct current and a resistance representative of A.C. losses due to eddy currents and hysteresis. The motor coil 40 is connected in a Maxwell bridge 44. The Maxwell bridge includes a resistor $R_1$ connected in parallel with the drive coil 40 from the input node 42, a resistor $R_T$ in series with the drive coil 40 and an RC circuit $R_2C_1$ in series with the resistor $R_1$. The circuit is designed such that:

$$R_L/R_T=R_1/R_2$$

$$L=C_1R_1R_T$$

The voltage across the bridge is detected by an operational amplifier 46.

The amplifier 46 of the Maxwell bridge 44 injects a gain and phase error which is corrected by an operational amplifier 48. That operational amplifier is associated with an RC circuit including a resistor $R_3$ equal to $R_2$, $R_4$ equal to $R_1$ and $C_2$ equal to $C_1$. The final output $E_b$ is the back EMF extracted from the voltage $E_C$ across the drive coil.

Figure 3:
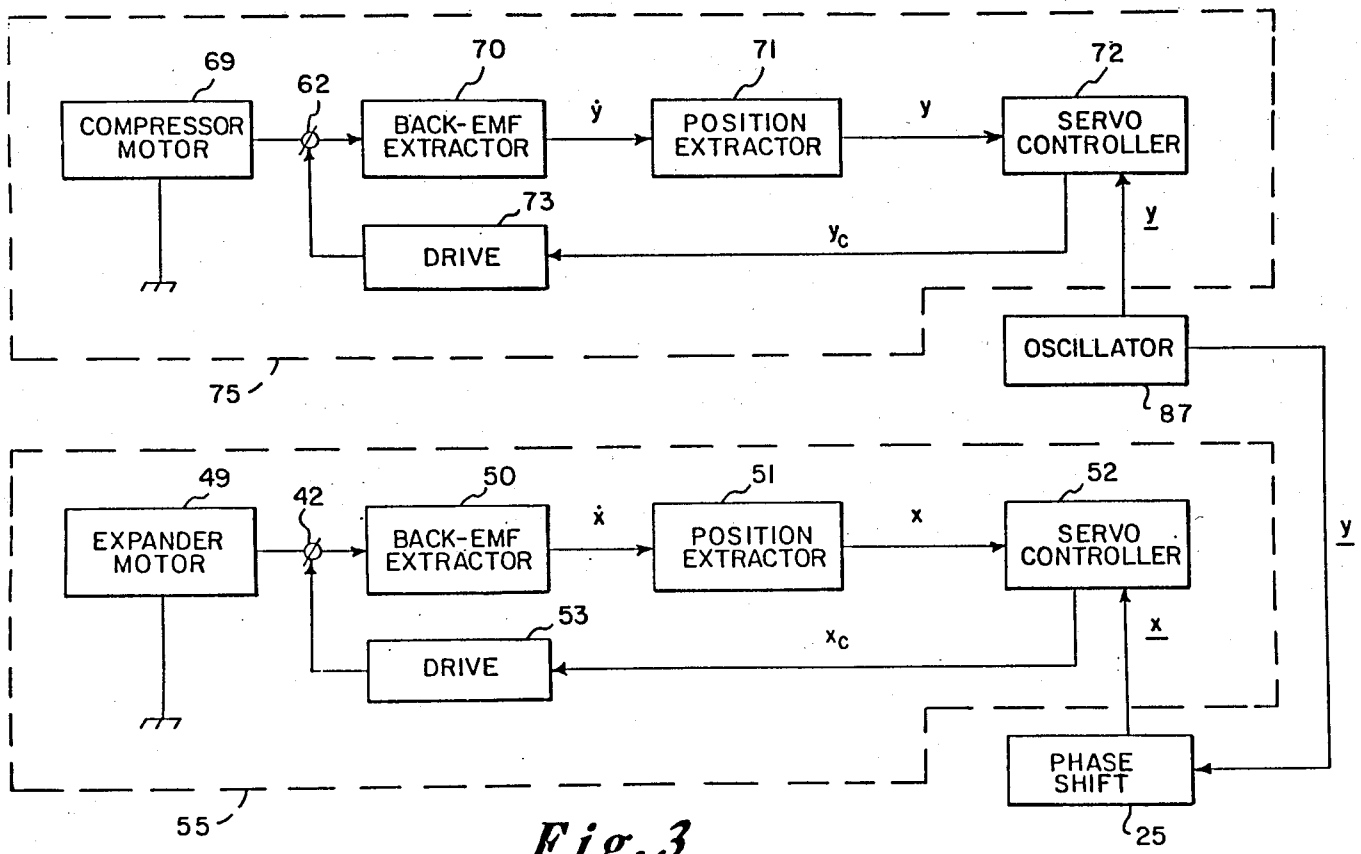
FIG. 3 is a block electrical diagram of one form of motor drive circuit for use in the system of FIG. 1.

A circuit for utilizing the back EMF derived from the drive coils of both the compressor drive motor and the displacer drive motor of FIG. 1 is illustrated in FIG. 3. It includes an expander controller 55 and a compressor controller 75.

A back EMF extractor 50 is connected across the coil of the displacer linear motor 49 at node 42. The output of the back-emf extractor is $E_b$, the back-emf of the expander. This back-emf is equal to the velocity of the expander x multiplied by the motor constant $K_m$ of the linear motor. In general, the motor constant is a function of displacer (or motor armature) position x. The control circuit can account for this fact, and so linearize the relationship such that $E_b$ and $\dot{x}$ are exactly proportional to each other, in spite of the actual motor properties. The back-emf signal $E_b$ can therefore be regarded as proportional to the displacer velocity x in all cases.

The integral over time of $E_b$ can then be performed by means of linear circuitry in a position extractor 51. By doing this, a signal voltage is generated proportional to the displacer position x. Mere integration does not provide the offset position of the displacer. The offset position of the displacer can be found because of the existence of solid mechanical stops at each end of its travel. Because of these mechanical stops, the displacer velocity $\dot{x}$ is abruptly brought to zero whenever it hits the stop at one end of its travel, or at the other end, or at both ends. The high frequency components present in the end stop signal serve to distinguish it from portions of the velocity signal which normally contain mostly the lowest, or fundamental frequency.

The output from the position extractor 51, which is labelled x, enters a further circuit element 52, the servo controller. The controller compares the actual position x of the displacer with a desired position x which is arriving from an outside source. The controller 52 generates an output signal $x_c$ such that x and x tend to converge in value.

The control wave $x_c$ is such that if a mechanical stop is being contacted repeatedly, then an offset builds up slowly to pull the displacer away from the mechanical stop. This action occurs at both ends of the displacer stroke. Meanwhile, there exists a bias such that the displacer can only just pull clear of the stops. This is required because some minimal contact with the stops is required to refresh the feedback loop.

The output of the servo controller 52 enters a drive circuit 53. This circuit raises the power levels enough to drive the motor by currents exchanged through node 42.

The compressor motor is controlled by a similar controller 75. In the compressor controller the back-emf extractor 70 is connected across the coil of the compressor motor 69 at a node 62. The velocity output y of the back-emf extractor is proportional to the back-emf of the compressor motor. That velocity signal is then applied to a position extractor 71 to generate the compressor position signal y. As with the expander controller, the position signal is applied to a servo controller to generator an output signal $y_c$. The signal $y_c$ is applied to a drive circuit 73 to generate the currents required to drive the compressor motor through the node 62.

Both controllers are driven by an oscillator 87. The output y is applied as an input directly to the compressor servo controller 72. The same signal is phase shifted in a circuit 85 to produce the signal x which is applied to the expander servo controller 52. The phase shift circuit 85 thus provides the desired phase relationship between the expander and compressor motors.

The controllers are based upon careful recovery and use of back-emf and also on having end-stop location signals generated by mechanical stops. The high frequency components of back-emf whenever the stops are contacted enables recovery of the dc information which otherwise is lost upon time integration. There are other techniques which would generate suitable high-frequency components. For example, the motor constant $K_m$ could have abrupt change of value near the stroke limits, obtained by shaping the iron elements in the motor.

While the invention has been particularly shown and described with reference to a preferred embodiment thereof, it will be understood by those skilled in the art that various changes in form and details may be made therein without departing from the spirit and scope of the invention as defined by the appended claims. For example, a back EMF extractor circuit has been described for providing the position indication. Alternatively, a high frequency carrier signal could be applied across the drive coil along with the drive current. That carrier signal would then be modulated by movement of the armature due to changes in the reactance of the coil. The envelope of the modulated signal would be directly related to the position of the armature. Also, although stationary coil motors are preferred in cryogenic applications, the invention could also be adapted to moving coil motors in cryogenic refrigerators.

I claim:

1. A cryogenic refrigerator comprising a gaseous working fluid which is alternately compressed and expanded to cool a portion of the working fluid to cryogenic temperatures and a linear drive motor for driving a piston element in the refrigerator which acts on the working fluid in a thermodynamic refrigeration cycle, the linear drive motor comprising a drive coil through which current is applied to drive an armature coupled to the piston element, the refrigerator further comprising:

a detector circuit coupled to the drive coil for sensing, throughout stroke of the piston element, an electrical parameter of the coil which is a function of movement of the armature and for generating from the electrical parameter of the coil a position signal indicative of position of the piston element; and motor drive circuitry for applying current to the drive coil, the motor drive circuitry being responsive to the position signal in controlling movement of the piston element throughout stroke of the piston element.

2. A cryogenic refrigerator as claimed in claim 1 wherein the detector circuit senses the back EMF across the drive coil.

3. A cryogenic refrigerator as claimed in claim 2 wherein the piston element is coupled to a displacer for displacing the working fluid through a thermal regenerator matrix.

4. A cryogenic refrigerator as claimed in claim 3 wherein the motor drive circuitry responds to the phase relationship between the displacer position and a reference wave.

5. A cryogenic refrigerator as claimed in claim 1 wherein the piston element is coupled to a displacer for displacing the working fluid through a thermal regenerator matrix.

6. A cryogenic refrigerator as claimed in claim 5 wherein the motor drive circuitry responds to the phase relationship between the displacer position and a reference wave.

7. A cryogenic refrigerator comprising means for generating a pressure wave in a gaseous working fluid and a displacer for displacing the working fluid through a thermal regenerator matrix in predetermined timed relationship with the pressure wave, the displacer being driven by a linear drive motor comprising a linear drive coil through which current is applied to drive an armature coupled to the displacer, the refrigerator further comprising:

a detector circuit coupled to the drive coil for sensing, throughout stroke of the displacer, an electrical parameter of the coil which is a function of movement of the armature and for generating from the electrical parameter of the coil a position signal indicative of position of the piston element; and motor drive circuitry for applying current to the drive coil, the motor drive circuitry being responsive to the position signal in controlling the relative phase of movement of the displacer to the pressure wave throughout stroke of the displacer.

8. A cryogenic refrigerator as claimed in claim 7 wherein the detector circuit senses the back EMF across the drive coil.

* * * * *